US009739210B2

(12) United States Patent
Kontani et al.

(10) Patent No.: US 9,739,210 B2
(45) Date of Patent: Aug. 22, 2017

(54) ENGINE INCLUDING MOTORIZED THROTTLE VALVE

(71) Applicant: HONDA MOTOR CO., LTD., Tokyo (JP)

(72) Inventors: Masahiro Kontani, Wako (JP); Hiroyuki Sugiura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 164 days.

(21) Appl. No.: 14/480,118

(22) Filed: Sep. 8, 2014

(65) Prior Publication Data

US 2015/0083078 A1 Mar. 26, 2015

(30) Foreign Application Priority Data

Sep. 25, 2013 (JP) ..... 2013-198511

(51) Int. Cl.
*F02D 11/10* (2006.01)
*F02D 9/10* (2006.01)
(Continued)

(52) U.S. Cl.
CPC ..... *F02D 9/1065* (2013.01); *F02D 9/107* (2013.01); *F02D 9/1095* (2013.01); *F02D 11/10* (2013.01);
(Continued)

(58) Field of Classification Search
CPC ... F01L 1/022; F01L 1/026; F01L 2001/0537; F01L 2250/04; F01L 2810/00; F02B 61/02; F02B 75/20; F02D 11/10; F02D 2700/0243; F02D 9/1065; F02D 9/107; F02D 9/1095; F02M 35/10177; F02M 35/162
See application file for complete search history.

(56) References Cited

U.S. PATENT DOCUMENTS 4,890,586 A * 1/1990 Fujii ..... F02B 27/0231 123/184.55
5,351,663 A * 10/1994 Makimura ..... F01L 1/02 123/54.8
(Continued)

FOREIGN PATENT DOCUMENTS

JP 4476421 B2 6/2010

*Primary Examiner* — Marguerite McMahon
*Assistant Examiner* — Tea Holbrook
(74) *Attorney, Agent, or Firm* — Birch, Stewart, Kolasch & Birch, LLP

(57) ABSTRACT

An engine including a motorized throttle valve that can implement mutually neighboring disposition of a throttle body and a cylinder head and can implement a good opening and closing responsibility thereof. A swelling portion is formed on a side wall of a valve chamber in such a manner so as to bite between those of throttle bodies which neighbor with each other in order to accept a protrusion of part of a valve system in a radial direction of first and second camshafts. An electric motor is disposed at one side of the group of the throttle bodies. A speed reduction mechanism, for transmitting output power of the electric motor to a valve shaft, is disposed between those throttle bodies, which neighbor with each other at a different location in the group of the throttle bodies, in a neighboring relationship with the valve chamber.

18 Claims, 8 Drawing Sheets

(51) Int. Cl.

| | |
|---|---|
| ***F02M 35/10*** | (2006.01) |
| ***F02M 35/16*** | (2006.01) |
| *F02B 61/02* | (2006.01) |
| *F02B 75/20* | (2006.01) |
| *F01L 1/02* | (2006.01) |
| *F01L 1/053* | (2006.01) |

(52) U.S. Cl.
CPC .... *F02M 35/10177* (2013.01); *F02M 35/162* (2013.01); *F01L 1/022* (2013.01); *F01L 1/026* (2013.01); *F01L 2001/0537* (2013.01); *F01L 2250/04* (2013.01); *F01L 2810/00* (2013.01); *F02B 61/02* (2013.01); *F02B 75/20* (2013.01); *F02D 2700/0243* (2013.01)

(56) References Cited

U.S. PATENT DOCUMENTS 6,257,188 B1 * 7/2001 Fujii ..... F02B 77/13 123/195 C
6,367,442 B1 * 4/2002 Takayanagi ..... F01L 1/024 123/195 P
6,378,478 B1 * 4/2002 Lagies ..... F01L 1/02 123/54.4
7,490,589 B2 * 2/2009 Itagaki ..... F02D 9/1065 123/396
8,555,855 B2 * 10/2013 Tsutsumi ..... F02D 9/1065 123/336
2005/0115530 A1 * 6/2005 Gokan ..... F01L 1/022 123/90.27
2005/0133004 A1 * 6/2005 Maehara ..... F02D 9/105 123/336
2006/0011168 A1 * 1/2006 Hanasato ..... F02D 9/1065 123/399
2007/0060444 A1 * 3/2007 Kawamura ..... F02D 11/10 477/107
2008/0017151 A1 * 1/2008 Kusaka ..... F01L 1/34413 123/90.31
2008/0087246 A1 * 4/2008 Matsuda ..... F01L 1/022 123/196 M
2008/0184956 A1 * 8/2008 Inui ..... F01L 1/022 123/193.5
2010/0077991 A1 * 4/2010 Tsutsumi ..... F02D 9/1065 123/336
2011/0056461 A1 * 3/2011 Kondo ..... F02D 9/105 123/403
2011/0192361 A1 * 8/2011 Sato ..... F02F 1/002 123/41.82 R
2013/0133600 A1 * 5/2013 Nagakura ..... F01M 9/10 123/90.34
2014/0123942 A1 * 5/2014 Tanaka ..... F02M 35/162 123/403

* cited by examiner

ENGINE INCLUDING MOTORIZED THROTTLE VALVE

CROSS-REFERENCE TO RELATED APPLICATIONS

The present application claims priority under 35 USC 119 to Japanese Patent Application No. 2013-198511 filed Sep. 25, 2013 the entire contents of which are hereby incorporated by reference.

BACKGROUND OF THE INVENTION

1. Field of the Invention

The present invention relates to improvement in or relating to an engine including a motorized throttle valve and further including a cylinder head joined to an upper end face of a cylinder block having three or more cylinders disposed in series to each other. A head cover is connected to an upper end face of the cylinder head with a valve system accommodated in a valve chamber defined by and between the cylinder head and the head cover and including first and second camshafts extending in parallel to each other. A plurality of throttle bodies are disposed at a side of the valve chamber and corresponding to the cylinders. An electric motor is connected to a valve shaft for throttle valves, which open and close intake paths of the throttle bodies, and are configured to drive the throttle valves to open or close.

2. Description of Background Art

An engine including a motorized throttle valve is disclosed in Japanese Patent No. 4476421.

In the engine including a motorized throttle valve disclosed in Japanese Patent No. 4476421, an electric motor is attached to one side face of an engine main body spaced from a throttle body such that output power of the electric motor is transmitted to a throttle valve through a control cable (Bowden wire). Therefore, while the throttle body and the cylinder head can be disposed in a neighboring relationship with each other without interfering with the electric motor, a transmission delay of the output power of the electric motor to the throttle valve occurs, due to the presence of the control cable (Bowden wire). Therefore, the opening and closing responsibility of the throttle valve is not good.

SUMMARY AND OBJECTS OF THE INVENTION

The present invention has been made in view of such a situation as described above. It is an object of an embodiment of the present invention to provide an engine including a motorized throttle valve which can implement mutually neighboring disposition of a throttle body and a cylinder head and can implement a good opening and closing responsibility of the throttle valve.

In order to achieve the object described above, according to an embodiment of the present invention, an engine having a motorized throttle valve includes a cylinder head joined to an upper end face of a cylinder block having three or more cylinders disposed in series to each other. A head cover is connected to an upper end face of the cylinder head with a valve system accommodated in a valve chamber defined by and between the cylinder head and the head cover and including first and second camshafts extending in parallel to each other. A plurality of throttle bodies is disposed at a side of the valve chamber and corresponds to the cylinders. An electric motor is connected to a valve shaft for throttle valves, which open and close intake paths of the throttle bodies, and are configured to drive the throttle valves to open or close. A speed reduction mechanism is configured to transmit output power of the electric motor to the valve shaft. A swelling portion is formed on a side wall of the valve chamber in such a manner so as to bite between those of the throttle bodies which neighbor with each other in order to accept a protrusion of part of the valve system in a radial direction of the first and second camshafts. The electric motor is disposed at one side of the group of the throttle bodies while the speed reduction mechanism is disposed between those throttle bodies, which neighbor with each other at a different location in the group of the throttle bodies, in a neighboring relationship with the valve chamber. It is to be noted that the first and second camshafts correspond to intake and exhaust camshafts 38 and 39, respectively, in embodiments of the present invention to be described later.

According to an embodiment of the present invention, the engine including the motorized throttle valve is configured with the electric motor being disposed between the valve chamber and the group of the throttle bodies in an offset relationship from the swelling portion in an axial direction of the first and second camshafts.

According to an embodiment of the present invention, the valve system includes a timing transmission apparatus that transmits output power of a crankshaft to the first camshaft, and a synchronization transmission apparatus that rotates the first and second camshafts in synchronism with each other.

According to an embodiment of the present invention, the timing transmission apparatus is disposed in a timing transmission chamber formed on an engine outer side wall so as to protrude to the outer side of the group of the cylinders and is connected to one end portion of the first camshaft.

According to an embodiment of the present invention, the synchronization transmission apparatus is configured from a pair of synchronization gears fixedly mounted on the first and second camshafts and meshing with each other.

According to an embodiment of the present invention, the synchronization transmission apparatus is configured from a pair of sprocket wheels fixedly mounted on the first and second camshafts, and an endless transmission belt extending between and around both of the sprocket wheels.

According to an embodiment of the present invention, the electric motor and the speed reduction mechanism are disposed such that a straight line which connects center axes of the valve shaft and a rotor shaft of the electric motor to each other is inclined in a direction in which the rotor shaft side of the straight line comes near to the upstream side of the intake path with respect to a center axial line of the intake path.

According to an embodiment of the present invention, the electric motor is disposed between the throttle body positioned at an intermediate location of the group of the throttle bodies and the valve chamber.

According to an embodiment of the present invention, the swelling portion is formed on the side wall of the valve chamber in such a manner as to bite between those of the throttle bodies which neighbor with each other in order to accept a protrusion of part of the valve system in a radial direction of the first and second camshafts. Therefore, the neighboring disposition of the throttle bodies with the valve chamber is permitted without interference by the swelling portion. Further, the electric motor is disposed at one side of the group of the throttle bodies while the speed reduction mechanism, which transmits output power of the electric motor to the valve shaft, is disposed between those throttle bodies, which neighbor with each other at a different location in the group of the throttle bodies, in a neighboring relationship with the valve chamber. Therefore, the neighboring disposition of the throttle body group with the valve chamber is permitted while mutual interference between the speed reduction mechanism and the swelling portion is avoided. Therefore, compactification around the cylinder head can be achieved. In addition, the output torque of the electric motor is transmitted to the intermediate portion of the valve shaft through the speed reduction mechanism without a delay and then transmitted from the intermediate portion of the valve shaft toward the opposite end portions of the valve shaft. Consequently, twist deformation of the valve shaft can be prevented or reduced to achieve tuning of all of the throttle valves. Accordingly, a balance in the output characteristics of all cylinders can be secured.

According to an embodiment of the present invention, the electric motor is disposed between the valve chamber and the group of the throttle bodies in an offset relationship from the swelling portion in an axial direction of the first and second camshafts. Therefore, the electric motor can be disposed between the valve chamber and the throttle body group without interference by the swelling portion, and compactification around the cylinder head can be implemented.

According to an embodiment of the present invention, the valve system includes the timing transmission apparatus which transmits output power of the crankshaft to the first camshaft, and the synchronization transmission apparatus which rotates the first and second camshafts in synchronism with each other. Therefore, the number of such driven sprocket wheels of the timing transmission apparatus which have a maximum diameter in the valve system may be only one. In addition, the synchronization gears can be formed with a smaller diameter than that of the driven sprocket wheel, and consequently, the distance between the axes of the intake and exhaust camshafts can be reduced. As a result, compactification of the valve chamber for accommodating the intake and exhaust camshafts therein and hence compactification of the cylinder head can be implemented.

According to an embodiment of the present invention, the timing transmission apparatus is disposed in the timing transmission chamber formed on the engine outer side wall so as to protrude to the outer side of the group of the cylinders. Therefore, the neighboring disposition of the throttle body group with the valve chamber is permitted without interference by the timing transmission apparatus. Consequently, compactification around the cylinder head can be implemented.

According to an embodiment of the present invention, the synchronization transmission apparatus is configured from the paired synchronization gears fixedly mounted on the first and second camshafts and meshing with each other. Therefore, the synchronization transmission apparatus can be configured from a minimum number of parts, and simplification of the structure can be implemented.

According to an embodiment of the present invention, the synchronization transmission apparatus is configured from the paired sprocket wheels fixedly mounted on the first and second camshafts, and the endless transmission belt extending between and around both of the sprocket wheels. Therefore, the synchronization sprocket wheels can be formed with a smaller diameter than that of the synchronization gears. Consequently, compactification of the valve chamber can be implemented.

According to an embodiment of the present invention, the electric motor and the speed reduction mechanism are disposed such that the straight line that connects the center axes of the valve shaft and the rotor shaft of the electric motor to each other is inclined in the direction in which the rotor shaft side of the straight line comes near to the upstream side of the intake path with respect to the center axial line of the intake path. Therefore, a small space between the valve chamber and the throttle body group can be effectively utilized as an installation space for the electric motor and the speed reduction mechanism. Consequently, that can contribute to compactification around the cylinder head.

According to an embodiment of the present invention, the electric motor is disposed between the throttle body positioned at the intermediate location of the group of the throttle bodies and the valve chamber. Therefore, the electric motor is entirely accommodated between the valve chamber and the throttle body group and the electric motor can be protected from an obstacle. Therefore, there is no necessity to take special protection means such as a cover.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, embodiments of the present invention are described with reference to the drawings.

Figure 1:
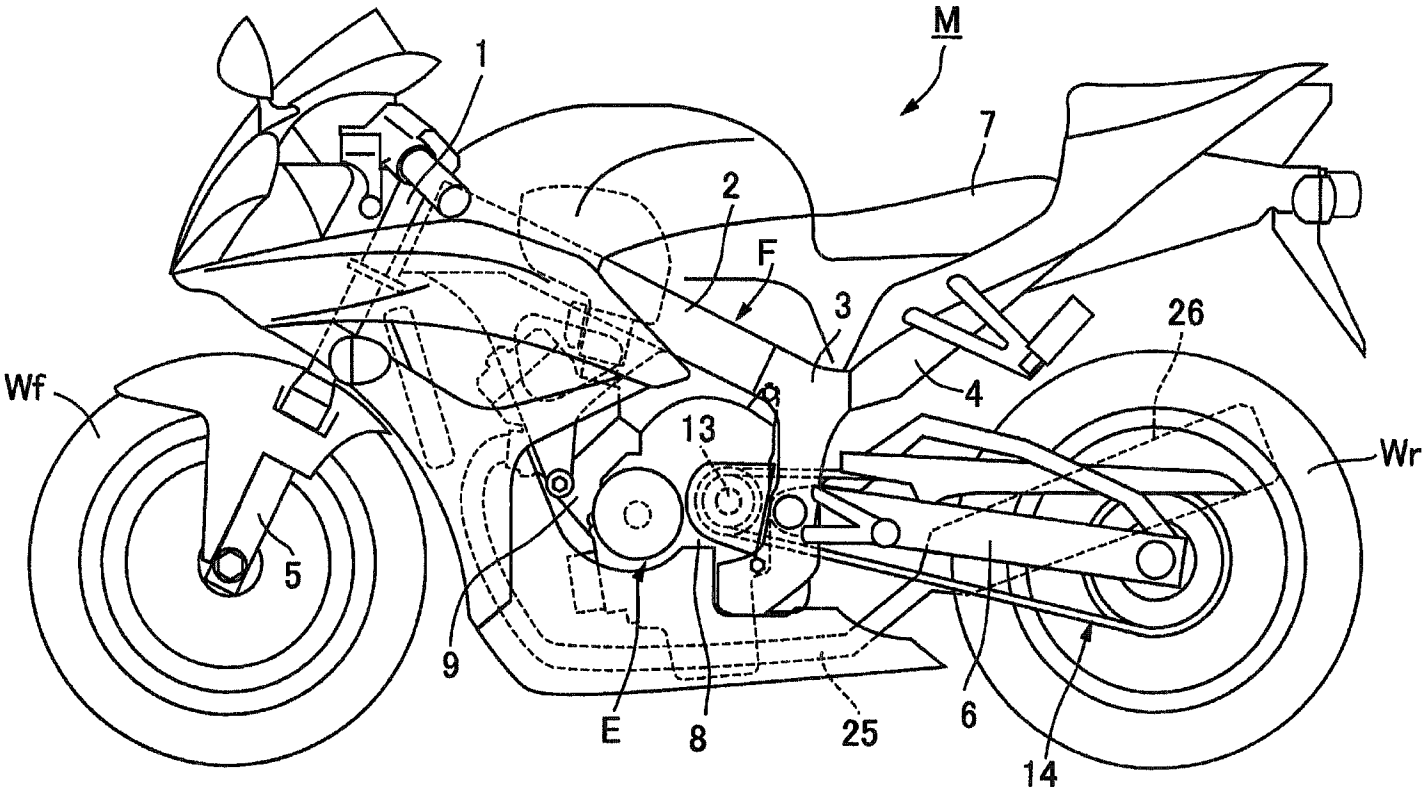
FIG. 1 is a left side elevational view of a motorcycle according to a first embodiment of the present invention.
Figure 2:
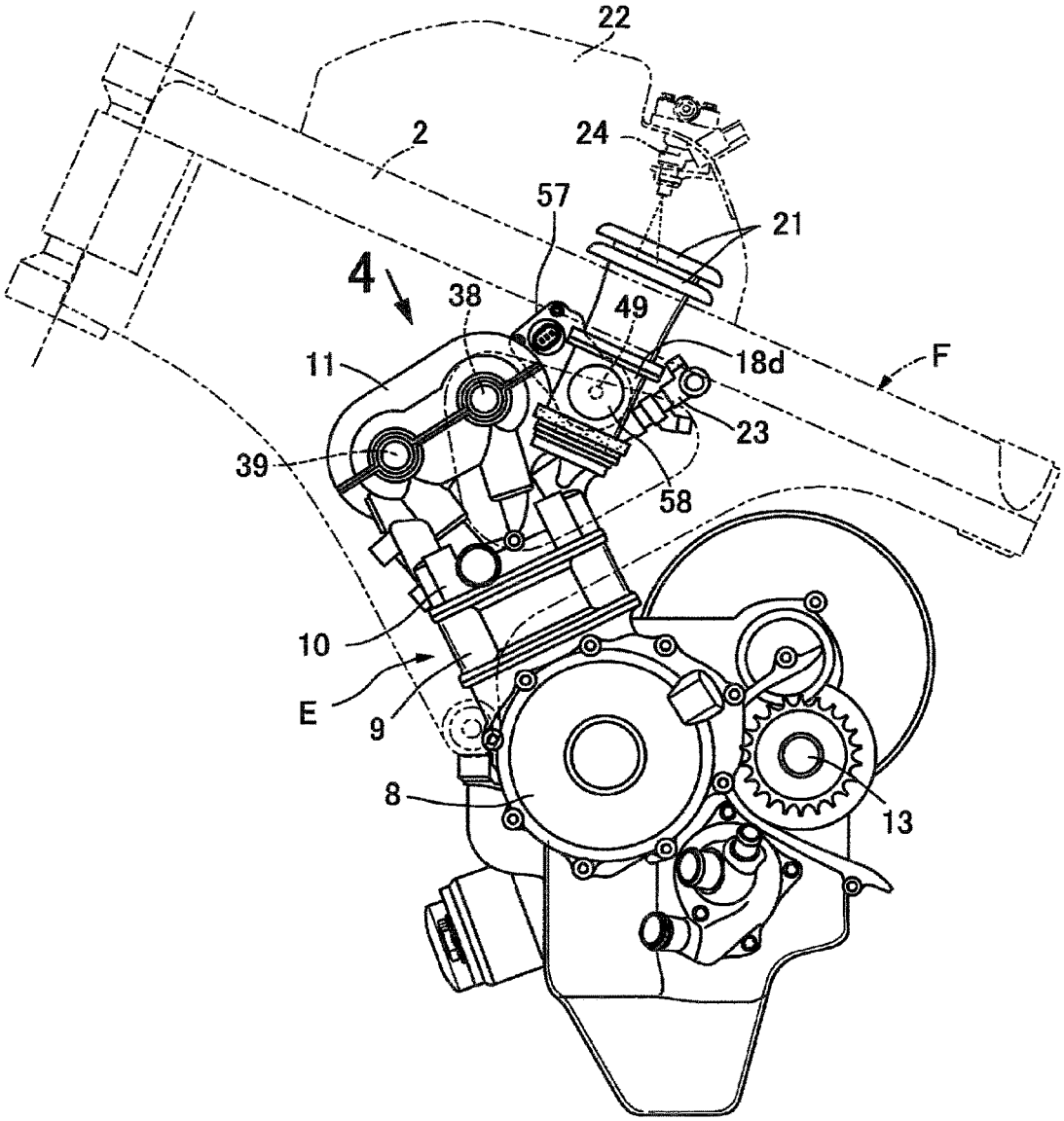
FIG. 2 is a left side elevational view of an engine of the motorcycle.

A first embodiment of the present invention is described with reference to FIGS. 1 to 7. In FIGS. 1 and 2, a vehicle body frame F of a motorcycle M is configured from a main frame 2 having a head pipe 1 at a front end thereof, a center frame 3 connected to a rear end of the main frame 2, and a rear frame 4 connected to a rear end of the center frame 3. A front fork 5 is attached for providing a steering motion to the head pipe 1 and supports a front wheel Wf thereon, and a rear fork 6 is attached for upward and downward rocking motion to the center frame 3 and supports a rear wheel Wr thereon. Further, a series multi-cylinder engine E is attached to the main frame 2 and the center frame 3 and has a forwardly inclined cylinder block 9 thereon, and a riding seat 7 is attached to an upper portion of the rear frame 4.

A speed change gear is accommodated in a crankcase 8 of the engine E. Output power of an output power shaft 13 of the speed change gear is transmitted to the rear wheel Wr through a chain transmission apparatus 14 disposed on the left side of the crankcase 8.

Figure 3:
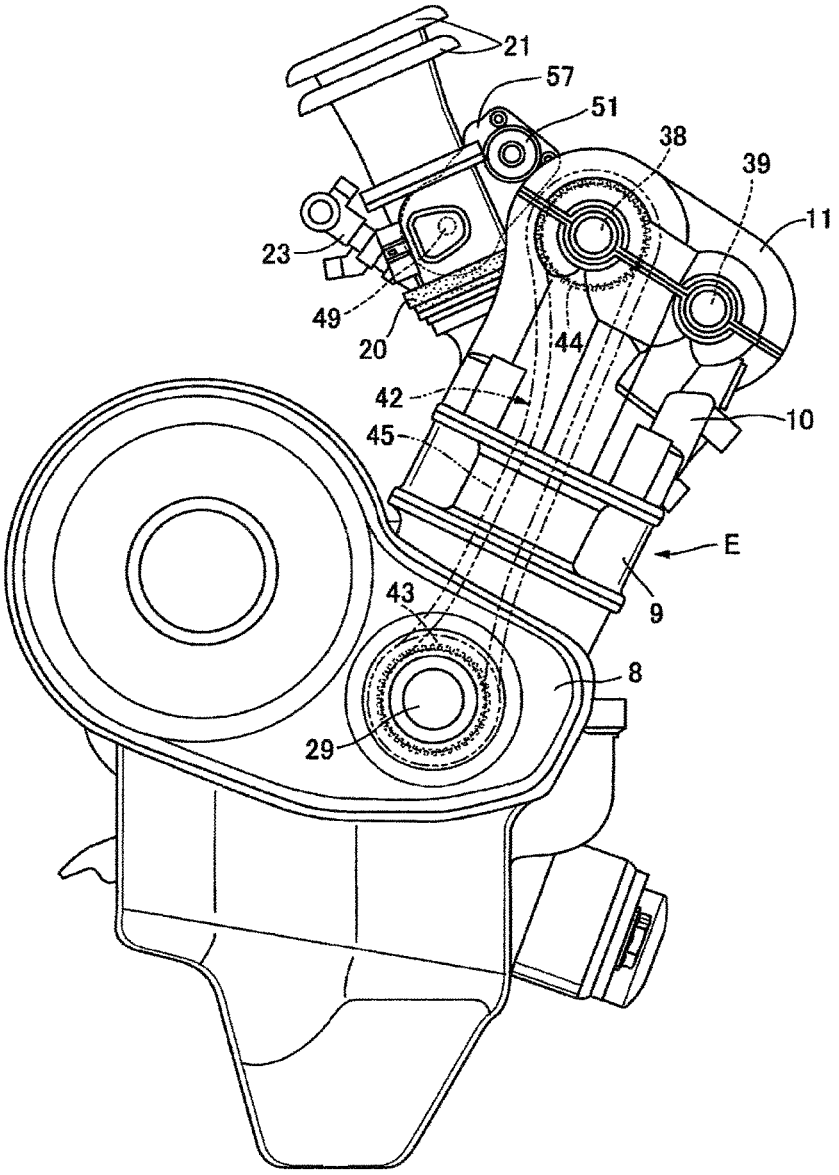
FIG. 3 is a right side elevational view of the engine of the motorcycle.
Figure 4:
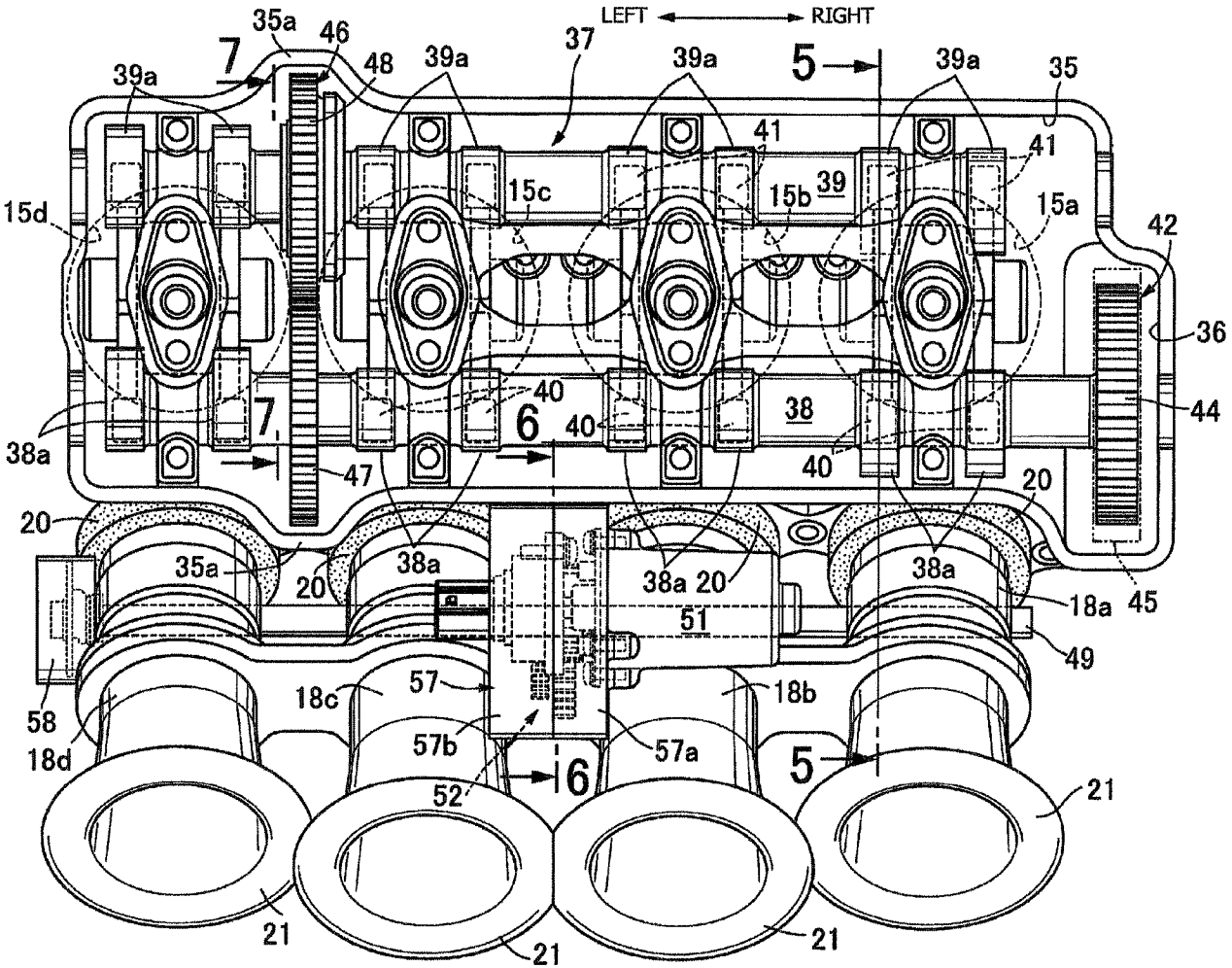
FIG. 4 is a view as viewed in a direction indicated by an arrow mark 4 of FIG. 2 depicting the engine in a state in which a head cover is removed.
Figure 5:
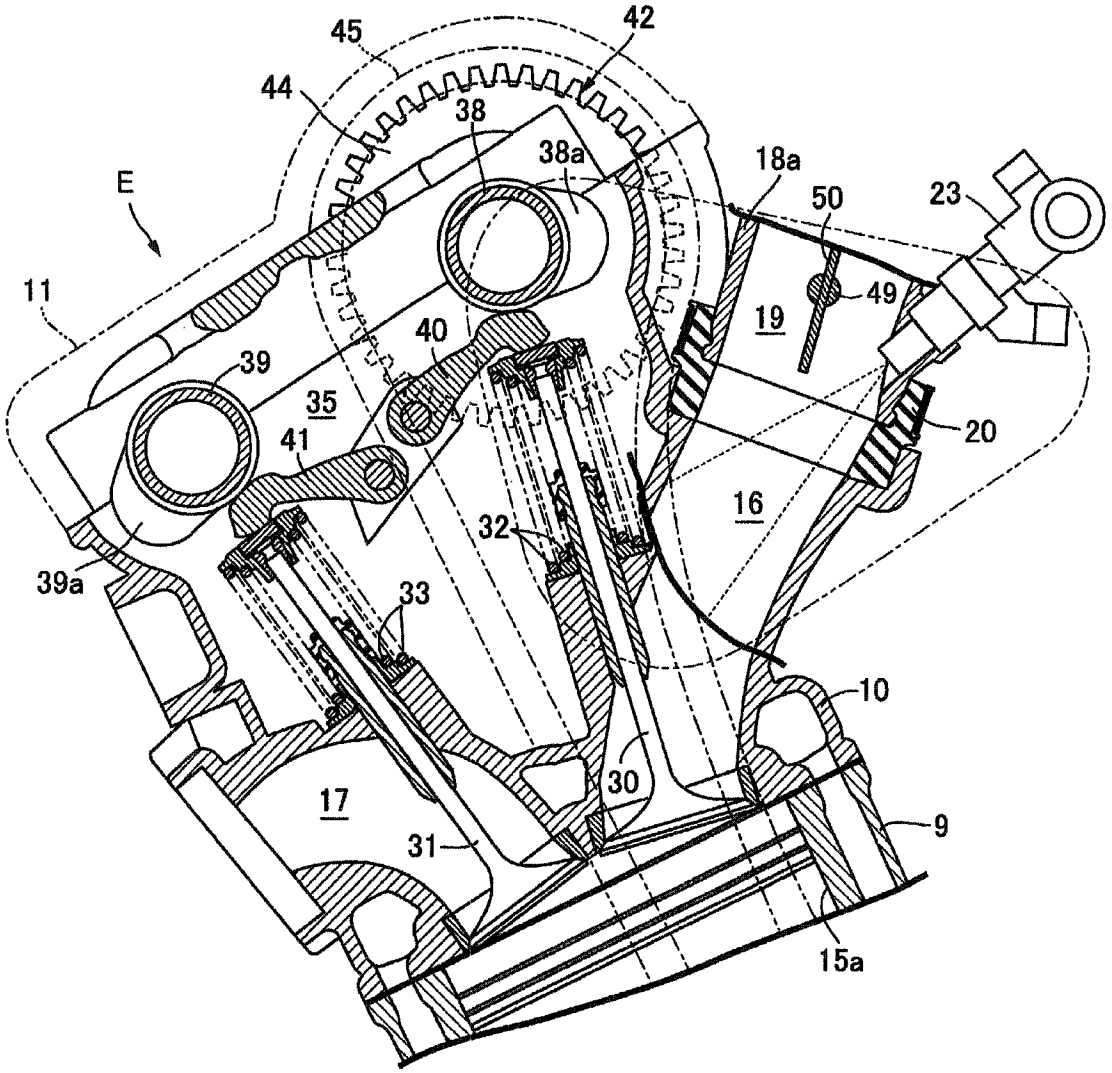
FIG. 5 is a sectional view taken along line 5-5 of FIG. 4.

Referring to FIGS. 3 to 5, the cylinder block 9 has four cylinders 15*a* to 15*d* juxtaposed in series with a cylinder head 10 is joined to an upper end of the cylinder block 9. A head cover 11 is joined to an upper end of the cylinder head 10. Further, an intake port 16 is opened to the rear face of the cylinder head 10 and continues to each of the four cylinders 15*a* to 15*d*. Meanwhile, an exhaust port 17 is opened to the front face of the cylinder head 10 and continues to each of the four cylinders 15*a* to 15*d*. Further, four throttle bodies 18*a* to 18*d* are connected to the rear face of the cylinder head 10 through heat insulation cylinders 20. Each of the throttle bodies 18*a* to 18*d* has an intake path 19 continuing to the intake port 16.

Funnels 21 are each connected to an upstream end of each of the throttle bodies 18*a* to 18*d* and accommodated in an air cleaner 22 (refer to FIG. 2), which is disposed at an upper portion of the main frame 2. A first fuel injection valve 23 is mounted on each of the throttle bodies 18*a* to 18*d* and injects fuel toward the intake port 16. A second fuel injection valve 24 is provided on the air cleaner 22 and injects fuel toward the funnels 21.

Exhaust pipes 25 are connected to the front face of the cylinder head 10 and continue to the exhaust ports 17, and the exhaust pipes 25 are coupled together and connected at the downstream side thereof to an exhaust muffler 26 disposed on the right side of the motorcycle M.

As depicted in FIGS. 4 and 5, a pair of intake valves 30 (only one is depicted in FIG. 5) for opening and closing the intake ports 16 and a pair of exhaust valves 31 (only one is depicted in FIG. 5) for opening and closing the exhaust ports 17 are provided in the cylinder head 10. The intake valves 30 and the exhaust valves 31 have an intake valve spring 32 and an exhaust valve spring 33 mounted thereon for biasing them in a closing direction, respectively.

A valve chamber 35 is defined between the cylinder head 10 and the head cover 11. A timing transmission chamber 36 is formed in an outer side wall of the engine E so as to extend from the crankcase 8 to the cylinder head 10 such that it communicates with one end portion of the valve chamber 35. A valve system 37 is disposed so as to extend from the timing transmission chamber 36 to the valve chamber 35.

The valve system 37 includes an intake camshaft 38 and an exhaust camshaft 39 supported on the cylinder head 10 in the valve chamber 35 and extending in parallel to the direction in which the cylinders 15*a* to 15*d* are arrayed. The intake camshaft 38 is disposed at the side of the throttle bodies 18*a* to 18*d* with respect to the exhaust camshaft 39.

The intake camshaft 38 has an intake cam 38*a* for opening and closing each of the intake valves 30 through an intake cam follower 40. Meanwhile, the exhaust camshaft 39 has an exhaust cam 39*a* for opening and closing each of the exhaust valves 31 through an exhaust cam follower 41. The intake cam follower 40 and the exhaust cam follower 41 are supported for rocking motion on the cylinder head 10.

In the group of the cylinders 15*a* to 15*d*, the cylinders are referred to as first to fourth cylinders 15*a* to 15*d* from the right side in FIG. 4, respectively. Further, in the group of the throttle bodies 18*a* to 18*d*, the throttle bodies are similarly referred to as first to fourth throttle bodies 18*a* to 18*d* from the right side in FIG. 4, respectively. The timing transmission chamber 36 is formed, in the example depicted, in an engine outer side wall at the first cylinder 15*a* side such that it protrudes to the outer side of the first throttle body 18*a*. A timing transmission apparatus 42 is disposed in the timing transmission chamber 36 and configured from a driving sprocket wheel 43, a driven sprocket wheel 44 and a timing chain 45. The driving sprocket wheel 43 is fixedly mounted at one end portion of a crankshaft 29. The driven sprocket wheel 44 is fixedly mounted at one end portion of the intake cam shaft 38. The timing chain 45 extends between and around the two sprocket wheels 43 and 44. The timing transmission apparatus 42 transmits rotation of the crankshaft 29 at a speed reduced to ½ to the intake camshaft 38.

Figure 7:
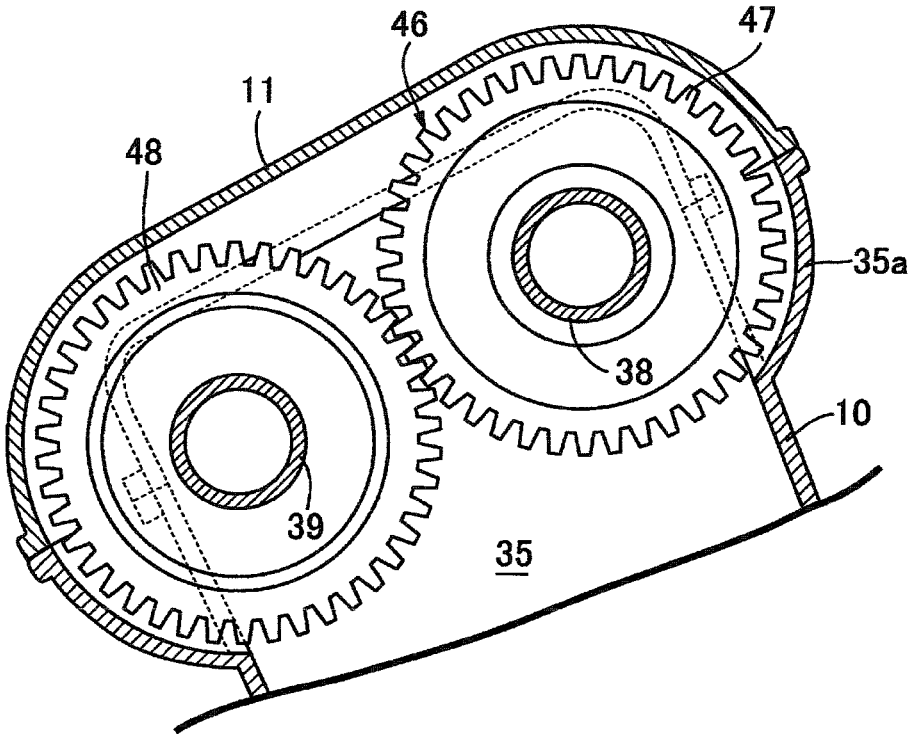
FIG. 7 is a sectional view taken along line 7-7 of FIG. 4.

Further, as depicted in FIGS. 4 and 7, in the valve chamber 35, the intake camshaft 38 and the exhaust camshaft 39 are connected to each other through a synchronization transmission apparatus 46. The synchronization transmission apparatus 46 is configured from synchronization gears 47 and 48 formed integrally at intermediate positions of the intake camshaft 38 and the exhaust camshaft 39 corresponding to each other between the third and fourth cylinders 15*c* and 15*d* and held in meshing engagement with each other. The synchronization gears 47 and 48 are formed with a diameter smaller than that of the driven sprocket wheel 44 of the timing transmission apparatus 42.

In addition, the synchronization gears 47 and 48 are configured such that, from a relationship wherein they protrude outwardly in a radial direction from the intake and exhaust camshafts 38 and 39, a swelling portion 35*a* is formed on a side wall of the valve chamber 35. The swelling portion 35*a* accepts protruding portions of the synchronization gears 47 and 48 therein. The swelling portion 35*a* is disposed such that it bites between the third and fourth throttle bodies 18*c* and 18*d*.

Figure 6:
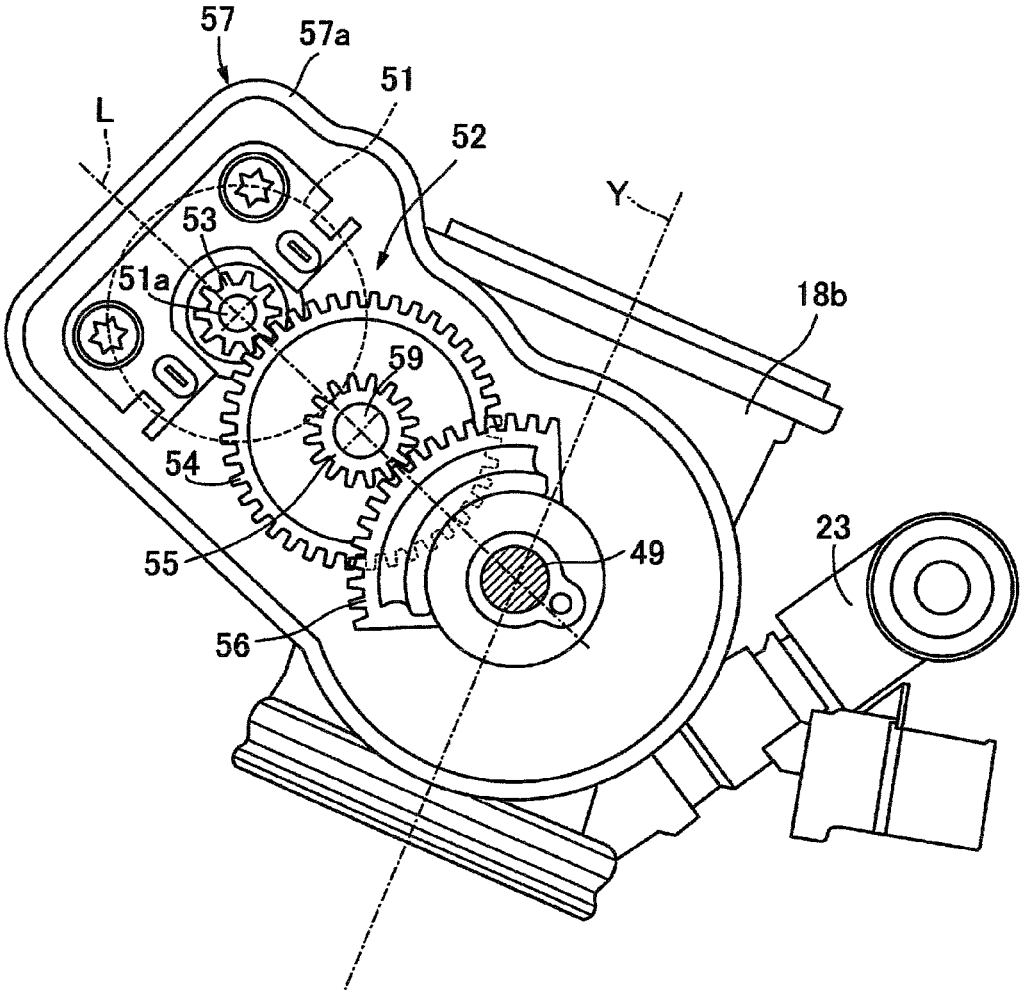
FIG. 6 is a sectional view taken along line 6-6 of FIG. 4.

As depicted in FIGS. 4 and 6, a valve shaft 49 is supported on the throttle bodies 18*a* to 18*d*. The valve shaft 49 extends in a direction in which the throttle bodies 18*a* to 18*d* are arrayed in such a manner so as to traverse the intake paths 19 of the throttle bodies 18*a* to 18*d*. A throttle valve 50 for opening and closing each of the intake paths 19 is provided on the valve shaft 49. An electric motor 51 is disposed between the second throttle body 18*b* and the valve chamber 35. In particular, the electric motor 51 is disposed in an offset relationship from the swelling portion 35*a* along an axial direction of the intake and exhaust camshafts 38 and 39. A rotor shaft 51*a* of the electric motor 51 is connected to the valve shaft 49 through a speed reduction mechanism 52 disposed between the second and third throttle bodies 18*b* and 18*c*.

As depicted in FIG. 6, the speed reduction mechanism is configured from a pinion gear 53, a first large diameter gear 54, a small diameter gear 55 and a second large diameter gear 56 of the sector type. The pinion gear 53 is fixedly mounted on the rotor shaft 51*a* of the electric motor 51. The first large diameter gear 54 is held in meshing engagement with the pinion gear 53. The small diameter gear 55 is formed coaxially with and integrally on the first large diameter gear 54. The second large diameter gear 56 is fixedly mounted on the valve shaft 49 and is held in meshing engagement with the small diameter gear 55. The speed reduction mechanism 52 transmits rotation of the rotor shaft 51*a* to the valve shaft 49 at a speed reduced by two stages.

A speed reduction case 57 that accommodates the speed reduction mechanism 52 is configured from case halves 57*a* and 57*b* formed integrally with the second and third throttle bodies 18*b* and 18*c*, respectively, and joined to each other. An intermediate shaft 59 is supported on the speed reduction case 57 and supports the first large diameter gear 54 and the small diameter gear 55, and the electric motor 51 is attached to the case half 57*a* at the second throttle body 18*b* side. The electric motor 51 and the speed reduction mechanism 52 are disposed such that the straight line L interconnecting the center axes of the rotor shaft 51*a* and the valve shaft 49 is inclined such that the rotor shaft 51*a* side thereof approaches the upstream side of the intake path 19.

A throttle sensor 58 is attached to an outer side wall of the first throttle body 18*a* or the fourth throttle body 18*d* at the outermost side from among the throttle bodies 18*a* to 18*d*. The throttle sensor 58 detects the angle of rotation of the valve shaft 49 as an opening of the throttle valve 50.

Now, the operation of the present embodiment is described.

During the operation of the engine E, the rotation of the crankshaft 29 is transmitted to the intake camshaft 38 at a speed reduced to ½ by the timing transmission apparatus 42. The rotation of the intake camshaft 38 is transmitted in synchronism to the exhaust camshaft 39 by the synchronization transmission apparatus 46. Consequently, the intake cams 38*a* of the intake camshaft 38 cooperate with the intake valve springs 32 to open and close the intake valves 30, and the exhaust cams 39*a* of the exhaust camshaft 39 cooperate with the exhaust valve springs 33 to open and close the exhaust valves 31. In this manner, the driving system for the intake and exhaust camshafts 38 and 39 is divided into the timing transmission apparatus 42 for driving one of the camshafts, in the example depicted, the intake camshaft 38, from the crankshaft 29 and the synchronization transmission apparatus 46 for synchronously connecting the both camshafts 38 and 39 to each other. Therefore, the number of such driven sprocket wheels 44 of the timing transmission apparatus 42 which have a maximum diameter in the driving system may be only one. In addition, the synchronization gears 47 and 48 are formed with a diameter smaller than that of the driven sprocket wheel 44. Consequently, the distance between axes of the intake and exhaust camshafts 38 and 39 can be reduced. As a result, compactification of the valve chamber 35 in which the intake and exhaust camshafts 38 and 39 are accommodated and hence compactification of the cylinder head 10 can be anticipated.

Further, the timing transmission apparatus 42 is disposed in the timing transmission chamber 36 formed in the outer side wall of the engine E in such a manner so as to protrude to the outer side of the first throttle body 18*a*. Therefore, the group of the throttle bodies 18*a* to 18*d* can be disposed in a neighboring relationship with the valve chamber 35 without interference with the timing transmission apparatus 42. Thus, compactification around the cylinder head 10 can be anticipated.

Further, the swelling portion 35*a* of the valve chamber 35 that accepts the protrusion of the synchronization transmission apparatus 46 is disposed in such a manner as to bite between the adjacent third and fourth throttle bodies 18*c* and 18*d*. Therefore, the group of the throttle bodies 18*a* to 18*d* can be disposed in a neighboring relationship with the valve chamber 35 without interference with the swelling portion 35*a*. Thus, further compactification around the cylinder head 10 can be anticipated.

Since the synchronization transmission apparatus 46 can be configured from the synchronization gears 47 and 48 in pair, it can be configured from a minimum number of parts, which can contribute to simplification of the structure.

Meanwhile, the electric motor 51 is controlled by an electronic controlling unit not depicted based on the operation amount of the accelerator operation member, opening of the throttle valve 50, engine speed and so forth. The electric motor 51 opens and closes the throttle valves of the throttle bodies 18*a* to 18*d* through the speed reduction mechanism 52 and the valve shaft 49.

In addition, the speed reduction mechanism 52 is disposed between the second and third throttle bodies 18*b* and 18*c* and is offset from the swelling portion 35*a* of the valve chamber 35 along the axial direction of the intake and exhaust camshafts 38 and 39. Therefore, the group of the throttle bodies 18*a* to 18*d* can be disposed in a neighboring relationship with the valve chamber 35 while mutual interference of the speed reduction mechanism 52 and the swelling portion 35*a* is prevented. Consequently, compactification around the cylinder head 10 can be anticipated. Further, since the speed reduction mechanism 52 is connected to a central portion of the valve shaft 49, the output torque of the electric motor 51 is transmitted to the central portion of the valve shaft 49 through the speed reduction mechanism 52 without delay. Further, the torque is transmitted from the central portion of the valve shaft 49 to the opposite ends of the valve shaft 49. Consequently, twist deformation of the valve shaft 49 is prevented or reduced and synchronization of all of the throttle valves 50 can be achieved. Accordingly, the balance in output characteristic of all of the cylinders 15*a* to 15*d* can be assured.

The electric motor 51 is disposed in an offset relationship from the swelling portion 35*a* along the axial direction of the intake and exhaust camshafts 38 and 39 between the valve chamber 35 and the group of the throttle bodies 18*a* to 18*d*. Therefore, the electric motor 51 can be disposed between the valve chamber 35 and the group of the throttle bodies 18*a* to 18*d* without interfering with the swelling portion 35*a*. Further, since the electric motor 51 disposed at one side of the second throttle body 18*b* at an intermediate position, the electric motor 51 is fully accommodated between the valve chamber 35 and the group of the throttle bodies 18*a* to 18*d*. Consequently, the electric motor 51 can be protected from an obstacle, and there is no necessity to use special protection means such as a cover.

Further, the electric motor 51 and the speed reduction mechanism 52 are disposed such that the straight line L interconnecting the center axes of the valve shaft 49 and the rotor shaft 51*a* of the electric motor 51 is inclined with respect to the center axial line Y of the intake path in a direction in which the rotor shaft 51*a* of the straight line L approaches the upstream side of the intake path 19. Therefore, the small space between the valve chamber 35 and the group of the throttle bodies 18*a* to 18*d* can be utilized effectively as an installation space for the electric motor 51 and the speed reduction mechanism 52. This can contribute to compactification around the cylinder head 10.

Figure 8:
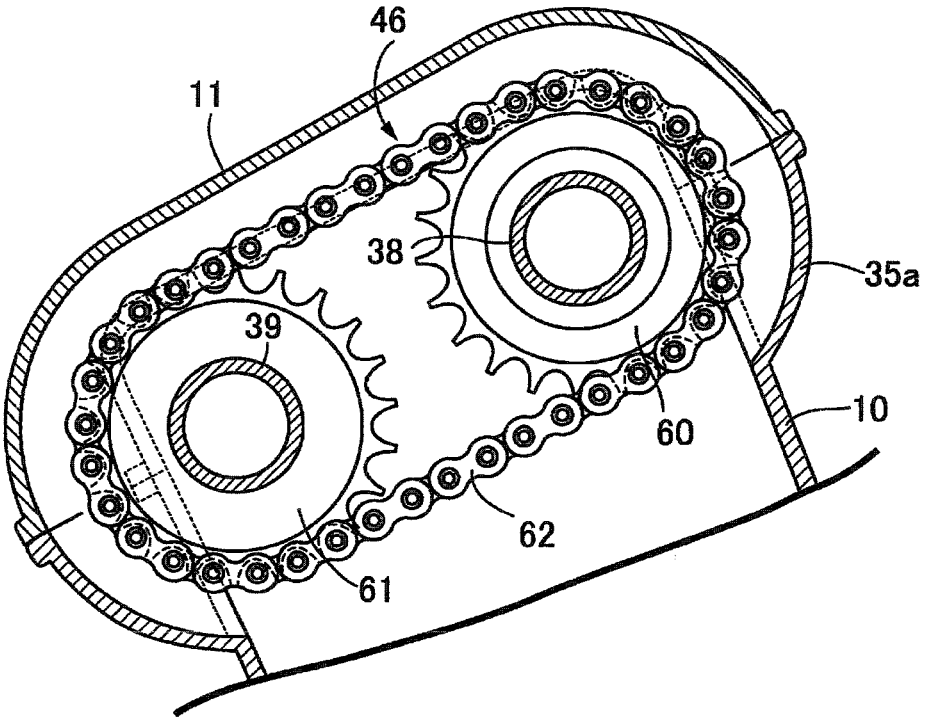
FIG. 8 is a view depicting a second embodiment of the present invention and corresponding to FIG. 7.

Now, a second embodiment of the present invention depicted in FIG. 8 is described.

In the present second embodiment, the synchronization transmission apparatus 46 is configured from a pair of synchronization sprocket wheels 60 and 61 fixedly provided on the intake camshaft 38 and the exhaust camshaft and a chain 62 extending between and around the synchronization sprocket wheels 60 and 61. The configuration of the other part of the motorcycle is similar to that of the preceding embodiment. Therefore, elements in FIG. 8 corresponding to those of the preceding embodiment are denoted by like reference symbols and overlapping description of them is omitted herein to avoid redundancy.

With the present second embodiment, the synchronization sprocket wheels 60 and 61 can be formed with a smaller diameter than the synchronization gears 47 and 48 in the preceding embodiment. Thus, compactification of the valve chamber 35 can be anticipated as much.

The embodiments of the present invention have been described. However, the present invention is not limited to the embodiments but can be modified in various manners without departing from the subject matter of the present invention. For example, the synchronization transmission apparatus 46 can be disposed also at a corresponding position between the first and second cylinders 15*a* and 15*b*. Further, if the speed reduction mechanism 52 is disposed between the first and second throttle bodies 18*a* and 18*b* or between the third and fourth throttle bodies 18*c* and 18*d* while the synchronization transmission apparatus 46 is disposed at a corresponding position between the first and second cylinders 15*a* and 15*b*, then also it is possible to avoid interference between the swelling portion 35*a* of the valve chamber 35 and the speed reduction mechanism 52. Also it is possible to provide a single chain extending between a driving sprocket wheel fixedly mounted on the crankshaft 29 and a pair of synchronization sprocket wheels fixedly mounted on the intake and exhaust camshafts 38 and 39 to integrate the timing transmission apparatus 42 and the synchronization transmission apparatus 46 with each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. An engine, comprising:

a cylinder head joined to an upper end face of a cylinder block having three or more cylinders disposed in series to each other;

a head cover connected to an upper end face of the cylinder head;

a valve system accommodated in a valve chamber defined by and between the cylinder head and the head cover and including first and second camshafts extending in parallel to each other;

a plurality of throttle bodies disposed at a side of the valve chamber and corresponding to the cylinders;

an electric motor connected to a valve shaft for throttle valves, for opening and closing intake paths of the throttle bodies, and configured to drive the throttle valves to open or close; and a gear train configured to transmit output power of the electric motor to the valve shaft, wherein the electric motor is disposed at one side of the group of the throttle bodies while the speed reduction mechanism is disposed between those throttle bodies, which neighbor with each other at a different location in the group of the throttle bodies, in a neighboring relationship with the valve chamber, wherein the electric motor is disposed between the valve chamber and the group of the throttle bodies in an offset relationship from a swelling portion of the valve chamber in an axial direction of the first and second camshafts, and wherein the gear train comprises:

a pinion gear attached to the electric motor;

a first gear meshing with the pinion gear; and a second gear attached to the valve shaft meshing with the first gear, wherein the second gear is sector shaped.

2. The engine according to claim 1, wherein the valve system includes a timing transmission apparatus for transmitting output power of a crankshaft to the first camshaft, and a synchronization transmission apparatus for rotating the first and second camshafts in synchronism with each other.

3. The engine according to claim 2, wherein the timing transmission apparatus is disposed in a timing transmission chamber formed on an engine outer side wall so as to protrude to the outer side of the group of the cylinders and is connected to one end portion of the first camshaft.

4. The engine according to claim 3, wherein the electric motor is disposed between the throttle body positioned at an intermediate location of the group of the throttle bodies and the valve chamber.

5. The engine according to claim 2, wherein the synchronization transmission apparatus is configured from a pair of synchronization gears fixedly mounted on the first and second camshafts and meshing with each other.

6. The engine according to claim 2, wherein the synchronization transmission apparatus is configured from a pair of sprocket wheels fixedly mounted on the first and second camshafts, and an endless transmission belt extending between and around both of the sprocket wheels.

7. The engine according to claim 2, wherein the electric motor is disposed between the throttle body positioned at an intermediate location of the group of the throttle bodies and the valve chamber.

8. The engine according to claim 1, wherein the electric motor and the speed reduction mechanism are disposed such that a straight line for connecting center axes of the valve shaft and a rotor shaft of the electric motor to each other is inclined in a direction in which the rotor shaft side of the straight line comes near to the upstream side of the intake path with respect to a center axial line of the intake path.

9. The engine according to claim 1, wherein the electric motor is disposed between the throttle body positioned at an intermediate location of the group of the throttle bodies and the valve chamber.

10. The engine according to claim 1, wherein the swelling portion is formed on a side wall of the valve chamber in such a manner as to bite between those of the throttle bodies which neighbor with each other in order to accept a protrusion of part of the valve system in a radial direction of the first and second camshafts.

11. The engine according to claim 1, wherein the first gear of the gear train comprises a first set of gear teeth meshing with the pinion gear and a second set of gear teeth meshing with the second gear, wherein the first set of gear teeth has a diameter greater than the second set of gear teeth.

12. An engine, comprising:

a cylinder head joined to an upper end face of a cylinder block having three or more cylinders disposed in series to each other;

a head cover connected to an upper end face of the cylinder head;

a valve system accommodated in a valve chamber defined by and between the cylinder head and the head cover and including first and second camshafts extending in parallel to each other;

a plurality of throttle bodies disposed at a side of the valve chamber and corresponding to the cylinders;

an electric motor connected to a valve shaft for throttle valves, for opening and closing intake paths of the throttle bodies, and configured to drive the throttle valves to open or close; and a gear train configured to transmit output power of the electric motor to the valve shaft, wherein the electric motor is disposed at one side of the group of the throttle bodies with the speed reduction mechanism being disposed between a second pair of predetermined throttle bodies, said second pair of predetermined throttle bodies being disposed at a different location in the group of the throttle bodies with respect to the first pair of predetermined throttle bodies, wherein the electric motor is disposed between the valve chamber and the group of the throttle bodies in an offset relationship from an enlarged portion of the valve chamber in an axial direction of the first and second camshafts, and wherein the gear train comprises:

a pinion gear attached to the electric motor;

a first gear meshing with the pinion gear; and a second gear attached to the valve shaft meshing with the first gear, wherein the second gear is sector shaped.

13. The engine according to claim 12, wherein the valve system includes a timing transmission apparatus for transmitting output power of a crankshaft to the first camshaft, and a synchronization transmission apparatus for rotating the first and second camshafts in synchronism with each other.

14. The engine according to claim 13, wherein the timing transmission apparatus is disposed in a timing transmission chamber formed on an engine outer side wall so as to protrude to the outer side of the group of the cylinders and is connected to one end portion of the first camshaft.

15. The engine according to claim 13, wherein the synchronization transmission apparatus is configured from a pair of synchronization gears fixedly mounted on the first and second camshafts and meshing with each other.

16. The engine according to claim 13, wherein the synchronization transmission apparatus is configured from a pair of sprocket wheels fixedly mounted on the first and second camshafts, and an endless transmission belt extending between and around both of the sprocket wheels.

17. The engine according to claim 13, wherein the enlarged portion is formed on a side wall of the valve chamber, said enlarged portion being positioned between a first pair of predetermined adjacent throttle bodies for accepting a protrusion formed as part of the valve system, said protrusion projecting in a radial direction of the first and second camshafts.

18. The engine according to claim 12, wherein the first gear of the gear train comprises a first set of gear teeth meshing with the pinion gear and a second set of gear teeth meshing with the second gear, wherein the first set of gear teeth has a diameter greater than the second set of gear teeth.

* * * * *